US006705607B2

(12) United States Patent
Eugster

(10) Patent No.: US 6,705,607 B2
(45) Date of Patent: Mar. 16, 2004

(54) DEVICE FOR TRANSPORTING PRINTED PRODUCTS

(75) Inventor: Albert Eugster, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/174,676

(22) Filed: Jun. 19, 2002

(65) Prior Publication Data

US 2003/0001332 A1 Jan. 2, 2003

(30) Foreign Application Priority Data

Jun. 29, 2001 (EP) ..... 01810633

(51) Int. Cl.[7] ..... B65H 29/04

(52) U.S. Cl. ..... 271/204; 271/205; 271/82; 271/85

(58) Field of Search ..... 271/264, 204, 271/205, 82, 85; 198/803.3, 803.15; 294/86.4

(56) References Cited

U.S. PATENT DOCUMENTS

| | | | | |
|---|---|---|---|---|
| 3,197,250 A | * | 7/1965 | Trotta et al. | 294/102.1 |
| 3,239,263 A | * | 3/1966 | Farmer et al. | 294/19.1 |
| 3,653,708 A | * | 4/1972 | Merola | 294/102.1 |
| 3,989,239 A | | 11/1976 | Scriven, Jr. et al. | |
| 4,664,577 A | | 5/1987 | Bonali | |
| 5,213,318 A | | 5/1993 | Newhall | |
| 5,263,415 A | * | 11/1993 | Pollich | 101/232 |
| 5,303,910 A | * | 4/1994 | McGill et al. | 271/21 |
| 5,794,929 A | | 8/1998 | Curley et al. | |
| 6,474,711 B2 | * | 11/2002 | Kazerooni et al. | 294/86.4 |
| 2002/0125727 A1 | * | 9/2002 | Kazerooni et al. | 294/86.4 |

FOREIGN PATENT DOCUMENTS

| | | | |
|---|---|---|---|
| CH | 322276 | 6/1957 | |
| DE | 2323432 | 11/1974 | |
| DE | 3638457 A1 * | 10/1987 | B65H/29/36 |
| EP | 0380921 | 8/1990 | |
| EP | 0 380 921 B1 | 2/1994 | |

* cited by examiner

*Primary Examiner*—Donald P. Walsh
*Assistant Examiner*—Matthew J. Kohner
(74) *Attorney, Agent, or Firm*—Friedrich Kueffner

(57) ABSTRACT

A device for transporting printed products has an endless circulating traction member having support frames. Receiving elements configured to pick up supplied printed products and to release the printed products are fastened on the endless circulating traction member at regular spacings on the support frames and are in the form of rollers having a circumference. The rollers cooperate in roller pairs with one another and define between its circumference, respectively, a conveying gap. The support frames have axles extending perpendicularly to the conveying direction of the printed products. The rollers are drivingly supported with one end thereof on the axles.

14 Claims, 3 Drawing Sheets

DEVICE FOR TRANSPORTING PRINTED PRODUCTS

BACKGROUND OF THE INVENTION

1. Field of the Invention

The invention relates to a device for transporting printed products, comprising an endless circulating traction member on which receiving means are fastened at regular spacings which are configured for picking up and subsequently releasing the supplied printed products.

2. Description of the Related Art

Such devices are known, inter alia, as cycled transporting devices in the printed product processing industry and transport individual printed products from a printing machine via several processing stations to the shipping area. This arrangement has a traction member formed by a guided chain on which, at regulars spacings, clamp-like grippers are fastened which, in the open position, pick up printed products at a supply station by closing the grippers and transport the printed products to a processing station arranged downstream where the printed products are released for removal by opening the grippers.

These known devices convey the printed product in a suspended state into a cycled rotating compartment wheel which inserts the printed products, for example, into pockets of an insertion machine. European patent 0 380 921 B1 describes such a device for loading an insertion machine with printed products.

These known devices lack precision and reliability, in particular, when a relatively high processing speed is to be employed.

SUMMARY OF THE INVENTION

It is an object of the present invention to provide a device which is of a simple configuration and with which the printed products can be supplied in a precise fashion with a relatively high processing speed.

In accordance with the present invention, this is achieved in that the receiving means comprise rollers cooperating in pairs and forming with their circumference a conveying gap, wherein the rollers are drivably supported with one end on axles arranged perpendicularly to the conveying direction on a support frame connected to the traction member.

A simple configuration can be achieved when at least one roller of a roller pair can be connected with a drive member.

For a direct utilization of the device according to the invention, it is advantageous when along the traction member at least one supply station for feeding printed products to the receiving means and at least one dispensing station for transferring the printed products to further processing station(s) are provided, when the supply and dispensing stations are in the form of drive members.

Preferably, the drive members are formed as stationary control curves or driven control means which realize an exact processing.

Expediently, for avoiding an inexact pick-up and dispensing of the printed products, the length of a stationary control curve is less than a division (spacing) between two receiving means fastened on the traction member.

When the printed products are pushed out of the receiving means in a direction opposite to the direction of the receiving action, an arrangement of the control curves such that the latter are staggered alternating on opposite sides along the traction member is particularly suitable.

A simple and proven configuration is provided when the roller pairs are in driving connection by means of gear wheels so that only one roller of the roller pair is driven by a drive member in the circulating direction.

In this connection, it is favorable when the roller driven by the drive member is provided on its circumference with a drive bead, wherein the rotational speed of the roller can be affected by changing the drive bead diameter.

For removing individual printed products from the sequentially arranged receiving means or for a regular partial removal of printed products, it is advantageous when the drive members correlated with the rollers to be driven are configured to be switched on as needed.

When the printed products to be received are relatively large, it may be necessary to provide a longer pick-up stretch so that the length of a stationary control curve should be greater than a division (spacing) between the receiving means.

When a longer pick-up stretch is required, it is advantageous when one supply station or dispensing station has two neighboring control curves having correlated therewith a drive bead of a roller to be driven of two sequentially arranged receiving means, respectively.

BRIEF DESCRIPTION OF THE DRAWING

In the following, the invention will be described by means of one embodiment with the aid of the drawing, reference being had to the drawing with regard to all details not disclosed particularly in the description. The drawings show in.

DESCRIPTION OF THE PREFERRED EMBODIMENTS

Figure 1:
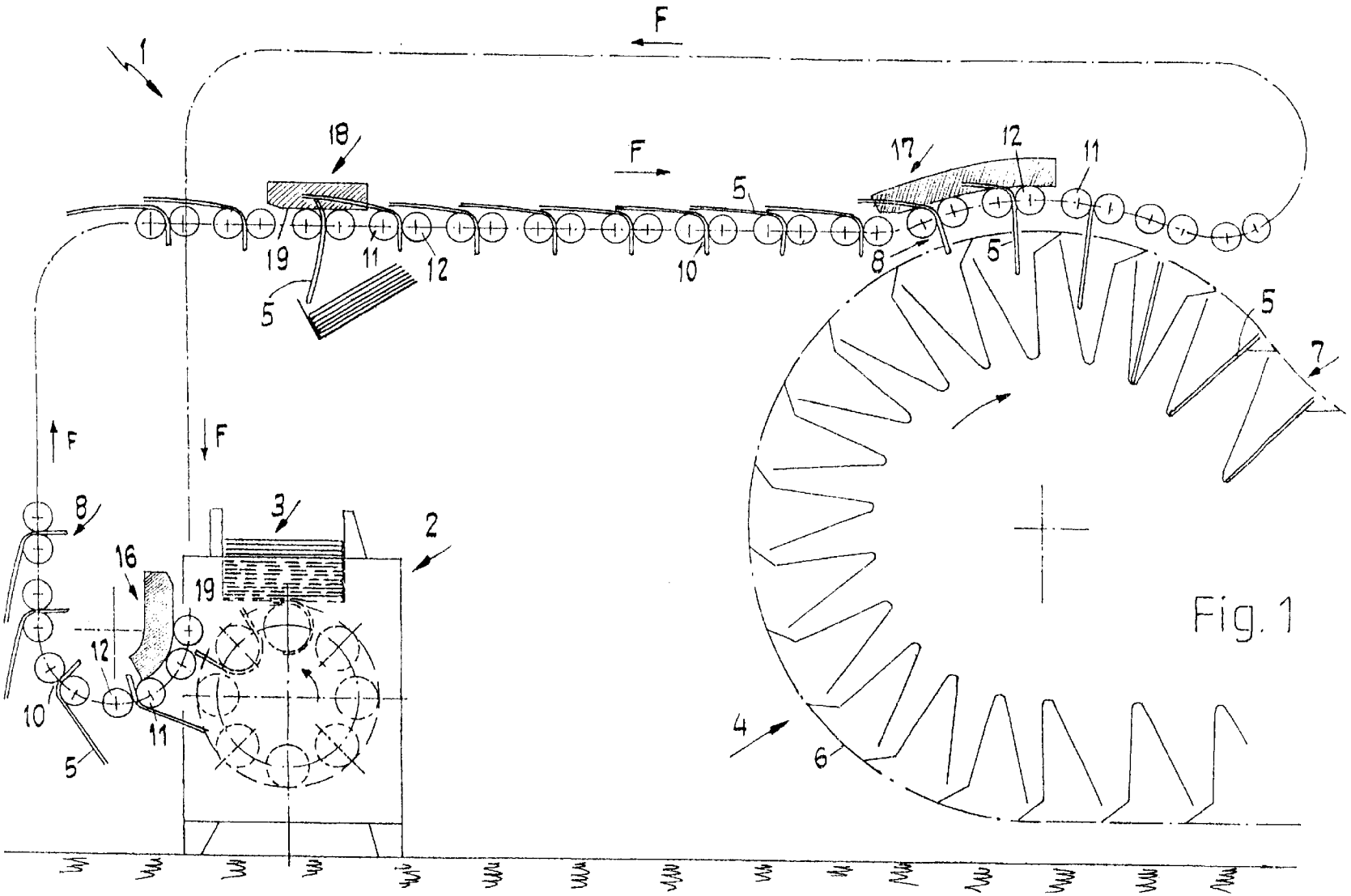
FIG. 1 a schematic illustration of a device for transporting printed products according to the invention.
Figure 2:
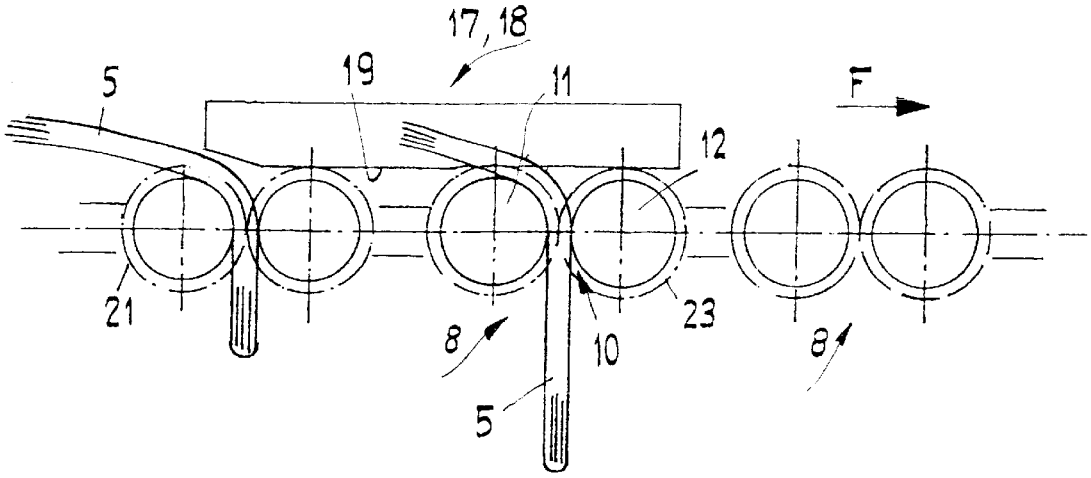
FIG. 2 a side view of a portion of the device illustrated in FIG. 1.

FIG. 1 shows the device 1 according to the invention for transporting printed products 5 removed individually by means of a so-called individualizing feeder 2 from a stack 3 to an insertion machine 4. The insertion machine 4 comprises pockets 7 circulating on chains 6 into which, as illustrated, the printed products 5 are inserted transversely to the conveying direction. In the illustrated embodiment the main products (printed products 5) transferred by the feeder 2 are supplied on an ascending section of a deflection wheel to the pockets 7 of the insertion machine 4 with the fold leading and opened on the adjoining descending section of the deflection wheel so that they can be supplied with the next printed product on the further conveying path for insertion. Prior to this, the printed products 5 are transferred by a delivery 9 of the feeder 2 or any other supply device onto receiving means 8 of the device 1 connected to the driven traction member 13 and received by the device 1. For this purpose, the printed products 5 are gripped, with the fold leading, approximately perpendicularly to the conveying direction of the device 1 having approximately the same speed as the insertion machine 4, on a conveying section communicating with the delivery 9 of the feeder 2. The receiving means 8 have two paired rollers 11, 12 cooperating with one another for conveying and forming about their circumference a conveying gap 10. One end of the rollers 11, 12 is supported to be rotatably driven in opposite directions on axles 15 arranged perpendicularly to the conveying direction F, wherein the axles 15 are connected to a support frame 14 connected to the traction member 13. Of the roller pairs 11, 12, the drive roller 12 which is the leading one in the conveying direction can be brought into driving connection with a drive member 27 at a supplying or receiving station 16 or dispensing station 17 of the printed products 5. The conveying section cooperating with the delivery 9 of the feeder 2 is formed as a supplying or receiving station 16 while a conveying section in the vicinity of the insertion machine 4 is configured as a dispensing station 17.

For the purpose of removing printed products 5 before transfer onto the insertion machine 4, a removal station 18 can be provided on the conveying path. The drive members 27 acting on the roller 12, as illustrated in FIGS. 1 through 3 and 5, can be formed by stationary or adjustable control curves 19.

Figure 4:
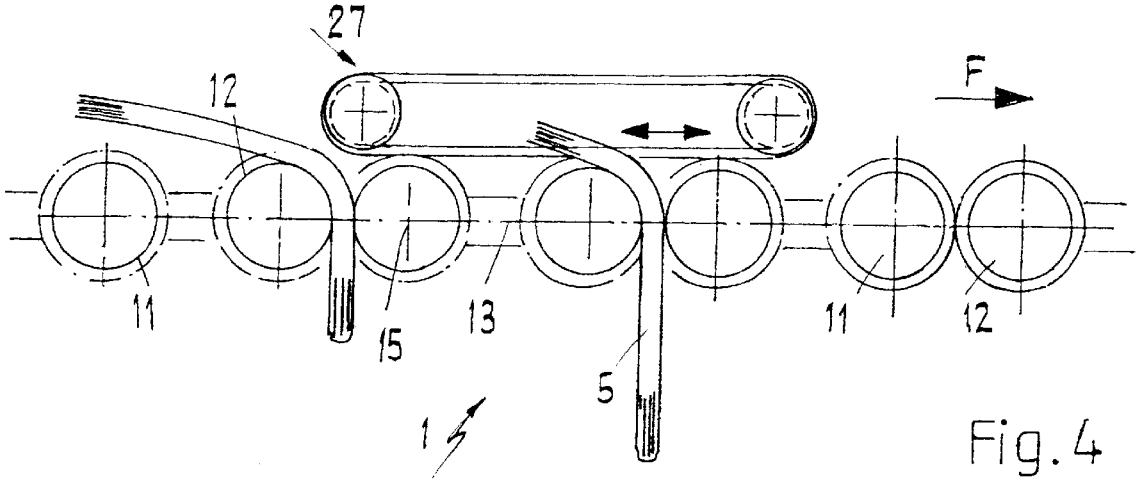
FIG. 4 a detail side view of an alternative drive member.

Also, driven control means, for example, a driven belt 20 acting onto the drive roller 12 and driven in rotation, as illustrated in FIG. 4, can be used as alternative drive members 27.

Adjustably configured control curves 19 or driven control means 20 can be switched off with regard to their action. As a result of the processing method and arrangement of the processing devices according to FIG. 1, the control curves 19 or control means 20 of the supply and dispensing stations 16, 17 or the removal station 18 along the traction member 13 of the device 1 are arranged alternatingly on opposite sides.

Figure 3:
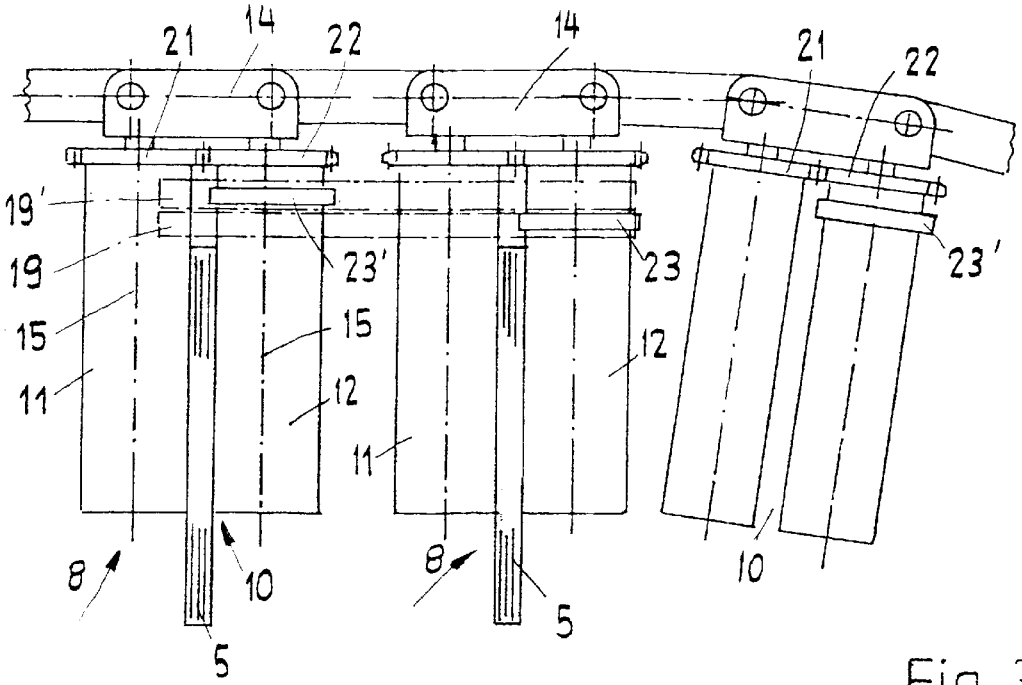
FIG. 3 a plan view onto the device illustrated in FIG. 2.

For providing the desired opposite rotation of the rollers 11, 12 of a receiving means 8 thus forming a conveying gap 10, which gap extends at the delivery 9 of the feeder 2 approximately parallel to the fold of the supplied printed products 5, preferably approximately horizontally, the rollers 11, 12 of a roller pair are connected drivingly by means of a gear wheel 21, 22, respectively (see FIG. 3).

The printed products 5 can be received by the receiving means 8 and dispensed in one direction or, by reversing the direction of rotation, can be dispensed in a direction opposite to that of the receiving action.

The drive of the rollers 11, 12 is realized by means of a drive bead 23 which projects annularly from the circumference of the roller 12 and, in order to provide an optimal use of the conveying gap 10, is connected thereto in the area of the one-sided support of the roller 12. By means of the adjustability of the drive members, they can be switched on and off.

For processing larger printed products 5 which require a longer pick-up stretch, the control curves 19 or the control means 20 have a length approximately as long as two divisions (spacing) of two receiving means 8 fastened on the traction member 13.

In one embodiment of the device 1 according to FIG. 3, a removal station 18 is formed by two adjacently positioned and staggered control curves 19, 19' or control means 20, 20' which are separately actuatable so that it is possible to remove a printed product from the device 1 at the removal station 18 without this affecting a printed product 5 also within the active range of the control curves 19, 19' or the control means 20, 20'.

Figure 5:
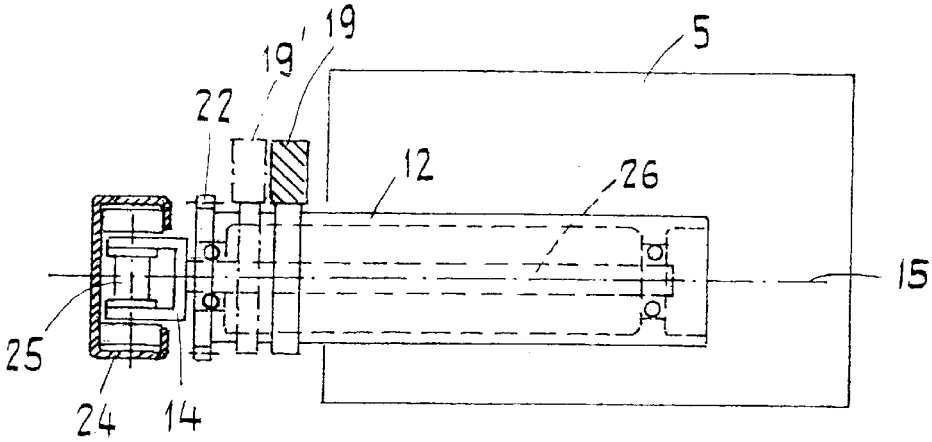
FIG. 5 a cross-section of receiving means of the device viewed in the travel direction.

In FIG. 5, the constructive configuration of the device 1 is illustrated in a simplified way. The receiving means 8 are attached in a floating arrangement in a guide device 24 of a link chain 25 used as the traction member 13. On the yoke-shaped support frame 14 two projecting pins 26 are fastened on which a roller 11, 12 is supported, respectively.

While specific embodiments of the invention have been shown and described in detail to illustrate the inventive principles, it will be understood that the invention may be embodied otherwise without departing from such principles.

What is claimed is:

1. A device for transporting printed products, the device comprising:

an endless circulating traction member having support frames;

receiving means configured to pick up supplied printed products and to release the printed products, wherein the receiving means are fastened on the endless circulating traction member at regular spacings;

wherein the receiving means are in the form of rollers having a circumference;

wherein the rollers cooperate in roller pairs with one another and wherein the roller pairs define between the circumference thereof, respectively, a conveying gap;

wherein the support frames have axles extending perpendicularly to the conveying direction of the printed products; and wherein the rollers are drivingly supported with one end thereof on the axles, respectively, at least one of the rollers of the roller pair is configured to be connected with a drive member, further comprising at least one supply station and at least one dispensing station in the form of drive members arranged along the traction member, and the drive members are formed by stationary control curves or adjustable control curves.

2. The device according to claim 1, wherein the stationary control curves or adjustable control curves have a length corresponding to one or several divisions between two neighboring of the receiving means fastened on the endless circulating traction member.

3. The device according to claim 1, wherein the control curves of the at least one supply station and the at least one dispensing station are arranged alternatingly on opposite sides along the traction member.

4. The device according to claim 1, comprising gear wheels arranged on the roller for drivingly connecting the roller pairs.

5. The device according to claim 1, wherein the drive members along the conveying path are configured such that a rotational direction of the rollers is reversible.

6. A device for transporting printed products, the device comprising:

an endless circulating traction member having support frames;

receiving means configured to pick up supplied printed products and to release the printed products, wherein the receiving means are fastened on the endless circulating traction member at regular spacings;

wherein the receiving means are in the form of rollers having a circumference;

wherein the rollers cooperate in roller pairs with one another and wherein the roller pairs define between the circumference thereof, respectively, a conveying gap;

wherein the support frames have axles extending perpendicularly to the conveying direction of the printed products; and wherein the rollers are drivingly supported with one end thereof on the axles, respectively, at least one of the rollers of the roller pair is configured to be connected with a drive member, further comprising at least one supply station and at least one dispensing station in the form of drive members arranged along the traction member, wherein the drive members are driven control means.

7. The device according to claim 6, wherein the driven control means of the at least one supply station and the at least one dispensing station are arranged alternatingly on opposite sides along the traction member.

8. The device according to claim 6, comprising gear wheels arranged on the roller for drivingly connecting the roller pairs.

9. The device according to claim 6, wherein the drive members along the conveying path are configured such that a rotational direction of the rollers is reversible.

10. A device for transporting printed products, the device comprising:

an endless circulating traction member having support frames;

receiving means configured to pick up supplied printed products and to release the printed products, wherein the receiving means are fastened on the endless circulating traction member at regular spacings;

wherein the receiving means are in the form of rollers having a circumference;

wherein the rollers cooperate in roller pairs with one another and wherein the roller pairs define between the circumference thereof, respectively, a conveying gap;

wherein the support frames have axles extending perpendicularly to the conveying direction of the printed products; and wherein the rollers are drivingly supported with one end thereof on the axles, respectively, at least one of the rollers of the roller pair is configured to be connected with a drive member, further comprising at least one supply station and at least one dispensing station in the form of drive members arranged along the traction member, wherein the at least one roller of the roller pair configured to be driven by the drive members has at least one drive bead arranged on the circumference.

11. The device according to claim 10, further comprising a removal station arranged between the at least one supply station and the at least one dispensing station and comprised of two separately arranged and actuatable control curves or control means correlated with the at least one drive bead of two sequential receiving means, respectively.

12. The device according to claim 10, wherein the drive members along the conveying path are configured such that a rotational direction of the rollers is reversible.

13. A device for transporting printed products, the device comprising:

an endless circulating traction member having support frames;

receiving means configured to pick up supplied printed products and to release the printed products, wherein the receiving means are fastened on the endless circulating traction member at regular spacings;

wherein the receiving means are in the form of rollers having a circumference;

wherein the rollers cooperate in roller pairs with one another and wherein the roller pairs define between the circumference thereof, respectively, a conveying gap;

wherein the support frames have axles extending perpendicularly to the conveying direction of the printed products; and wherein the rollers are drivingly supported with one end thereof on the axles, respectively, at least one of the rollers of the roller pair is configured to be connected with a drive member, further comprising at least one supply station and at least one dispensing station in the form of drive members arranged along the traction member, wherein the drive members are configured to be switched on as needed.

14. The device according to claim 13, wherein the drive members along the conveying path are configured such that a rotational direction of the rollers is reversible.

* * * * *